US006463700B2

(12) United States Patent
Davis

(10) Patent No.: US 6,463,700 B2
(45) Date of Patent: Oct. 15, 2002

(54) COMPOSITE GUTTER GUARD

(75) Inventor: Harry H. Davis, Mooresville, NC (US)

(73) Assignee: L.B. Plastics Limited, Darby (GB)

( * ) Notice: Subject to any disclaimer, the term of this patent is extended or adjusted under 35 U.S.C. 154(b) by 0 days.

(21) Appl. No.: 09/760,557

(22) Filed: Jan. 16, 2001

(65) Prior Publication Data

US 2001/0037610 A1 Nov. 8, 2001

Related U.S. Application Data

(60) Provisional application No. 60/197,454, filed on Apr. 17, 2000.

(51) Int. Cl.[7] ..... E04D 13/00

(52) U.S. Cl. ..... 52/12; 52/94; 52/11; 52/95; 210/474; 210/490; 210/498; 210/499

(58) Field of Search ..... 52/12, 94; 210/163, 210/162, 490, 499, 498

(56) References Cited

U.S. PATENT DOCUMENTS

| | | | | | |
|---|---|---|---|---|---|
| 474,442 | A | | 5/1892 | Byers | |
| 877,456 | A | | 1/1908 | Sander | |
| 3,053,393 | A | * | 9/1962 | McLean | 210/474 |
| 3,295,264 | A | * | 1/1967 | Olson | 52/12 |
| 3,507,396 | A | | 4/1970 | Homa | |
| 4,553,357 | A | | 11/1985 | Pepper | |
| 4,769,957 | A | | 9/1988 | Knowles | |
| 4,841,686 | A | | 6/1989 | Rees | |
| 4,959,932 | A | | 10/1990 | Pfeifer | |
| 4,965,969 | A | | 10/1990 | Antenen | |
| 5,406,754 | A | * | 4/1995 | Cosby | 52/12 |
| 5,555,680 | A | * | 9/1996 | Sweers | 52/12 |
| 5,848,857 | A | * | 12/1998 | Killworth et al. | 405/118 |
| 5,906,074 | A | * | 5/1999 | Bell | 52/12 |

* cited by examiner

*Primary Examiner*—Carl D. Friedman
*Assistant Examiner*—Basil Katcheves
(74) *Attorney, Agent, or Firm*—Adams, Schwartz & Evans, P.A.

(57) ABSTRACT

A composite gutter guard is adapted for being positioned at an opening of a longitudinally extending, generally U-shaped gutter used for collecting and distributing rainwater runoff from the roofs of residential homes and other buildings. The gutter guard includes an elongate polymer guard panel defining a plurality of spaced filter openings. The guard panel is adapted to extend laterally across the opening of the gutter and longitudinally along the length of the gutter. A polymer-coated mesh layer overlies the guard panel in an area of the filter openings and cooperates with the guard panel to capture and separate debris from rainwater runoff entering the gutter. A heat weld connects the mesh layer to the guard panel.

14 Claims, 2 Drawing Sheets

COMPOSITE GUTTER GUARD

BACKGROUND OF THE INVENTION

This invention relates to a composite gutter guard. The invention is positioned over the opening of a conventional, longitudinally-extending, generally U-shaped gutter used for collecting and distributing rainwater runoff from the roofs of residential homes and other buildings. The invention employs a dual filtering system applicable for separating small twigs, leaves, pine needles, acorns, and other debris from rainwater entering the gutter. The invention effectively prevents this debris from passing into the gutter and clogging the downspouts. The invention's integrally-formed attachment means helps secure the gutter guard in position on the gutter, provides added support to help prevent the gutter guard from collapsing under the weight of wet leaves and other debris, and resists separation of the gutter guard from the gutter in windy conditions.

Unlike some prior art gutter guards which have a relatively fine-mesh metal layer overlying a perforated polymer guard panel, the gutter guard of the present invention includes a coated mesh layer and perforated guard panel formed of like polymer materials, such as PVC. This novel construction facilitates an effective and secure attachment of the composite by ultrasonic or heat welding along the entire length of the gutter guard. The attachment means used in other prior art gutter guards incorporating multiple layers is generally less effective, and more costly, time consuming, and labor intensive. Moreover, the core material of the mesh layer, according to one embodiment of the invention, is fiberglass fabric. As compared to metal, fiberglass fabric is generally easier to handle, is chemically more stable and will not corrode. Fiberglass fabric is also more durable than plastic and possesses greater natural strength which allows for a substantially finer and thinner construction.

BRIEF SUMMARY OF THE INVENTION

Therefore, it is an object of the invention to provide a composite gutter guard which effectively filters both large and small debris from rainwater entering the gutter.

It is another object of the invention to provide a gutter guard which helps prevent the gutter downspouts from clogging.

It is another object of the invention to provide a gutter guard which substantially reduces the time and effort required to clean the gutter.

It is another object of the invention to provide a gutter guard which securely attaches over the top opening of the gutter.

It is another object of the invention to provide a gutter guard which will not readily separate from the gutter in windy conditions.

It is another object of the invention to provide a gutter guard which will not readily collapse under the weight of wet leaves and other debris.

It is another object of the invention to provide a gutter guard which includes a fine mesh layer formed of a vinyl-coated fiberglass fabric.

It is another object of the invention to provide a gutter guard which includes a fine mesh layer coated with the same polymer material used to form the underlying perforated guard panel in order to facilitate attachment of the fine mesh layer using ultrasonic or heat welding.

It is another object of the invention to provide a gutter guard which includes one or more continuous, longitudinal weld lines attaching the fine mesh layer to the underlying guard panel along the entire length of the mesh layer.

These and other objects of the present invention are achieved in the preferred embodiments disclosed below by providing a composite gutter guard. The gutter guard is adapted for being positioned at an opening of a longitudinally extending, generally U-shaped gutter used for collecting and distributing rainwater runoff from the roofs of residential homes and other buildings. The gutter guard includes an elongate polymer guard panel defining a plurality of spaced filter openings. The guard panel is adapted to extend laterally across the opening of the gutter and longitudinally along the length of the gutter. A polymer-coated mesh layer overlies the guard panel in an area of the filter openings and cooperates with the guard panel to capture and separate debris from rainwater runoff entering the gutter. A heat weld connects the mesh layer to the guard panel.

According to another preferred embodiment of the invention, a connecting member is provided for securing the guard panel in position at the opening of the gutter.

According to another preferred embodiment of the invention, the connecting member includes a generally C-shaped connecting strip having resilient spaced-apart top and bottom walls adapted for receiving an inwardly-extending flange of the gutter to hold the gutter guard in position during use.

According to another preferred embodiment of the invention, the mesh layer is formed of fiberglass fabric.

According to another preferred embodiment of the invention, the mesh layer has a PVC coating.

According to another preferred embodiment of the invention, the filter openings in the guard panel are between 0.5 and 1.5 centimeters in diameter.

According to another preferred embodiment of the invention, the mesh layer includes between 30 and 40 openings per square centimeter.

According to another preferred embodiment of the invention, the mesh layer extends along the length of the guard panel, and has first and second opposing side edges and first and second opposing end edges.

According to another preferred embodiment of the invention, a longitudinal weld line extends continuously along the entire length of the mesh layer from one end edge thereof to the other.

According to another preferred embodiment of the invention, first and second laterally spaced weld lines are located adjacent respective first and second side edges of the mesh layer, and extend continuously along the entire length of the mesh layer from one end edge thereof to the other.

In another embodiment, the invention is a composite gutter guard adapted for being positioned at an opening of a longitudinally extending, generally U-shaped gutter used for collecting and distributing rainwater runoff from the roofs of residential homes and other buildings. The gutter guard includes an elongate polymer guard panel defining a plurality of spaced filter openings. A polymer-coated fiberglass mesh layer overlies the guard panel in an area of the filter openings and cooperates with the guard panel to capture and separate debris from rainwater runoff entering the gutter. The mesh layer has first and second opposing side edges and first and second opposing end edges. A longitudinal weld line connects the mesh layer to the guard panel, and extends continuously from one end edge of the mesh layer to the other. A connecting member secures the guard panel in position at the opening of the gutter.

In yet another embodiment, the invention is a method of forming a composite gutter guard. The gutter guard is adapted for being positioned at an opening of a longitudinally extending, generally U-shaped gutter used for collecting and distributing rainwater runoff from the roofs of residential homes and other buildings. The method includes the steps of forming a plurality of filter openings in an elongate polymer guard panel. A polymer-coated mesh layer is then applied over the guard panel in an area of the filter openings. The mesh layer cooperates with the guard panel to capture and separate debris from rainwater runoff entering the gutter. The mesh layer is then welded to the guard panel.

BRIEF DESCRIPTION OF THE SEVERAL VIEWS OF THE DRAWINGS

Some of the objects of the invention have been set forth above. Other objects and advantages of the invention will appear as the description proceeds when taken in conjunction with the following drawings, in which.

DETAILED DESCRIPTION OF THE INVENTION

Figure 1:
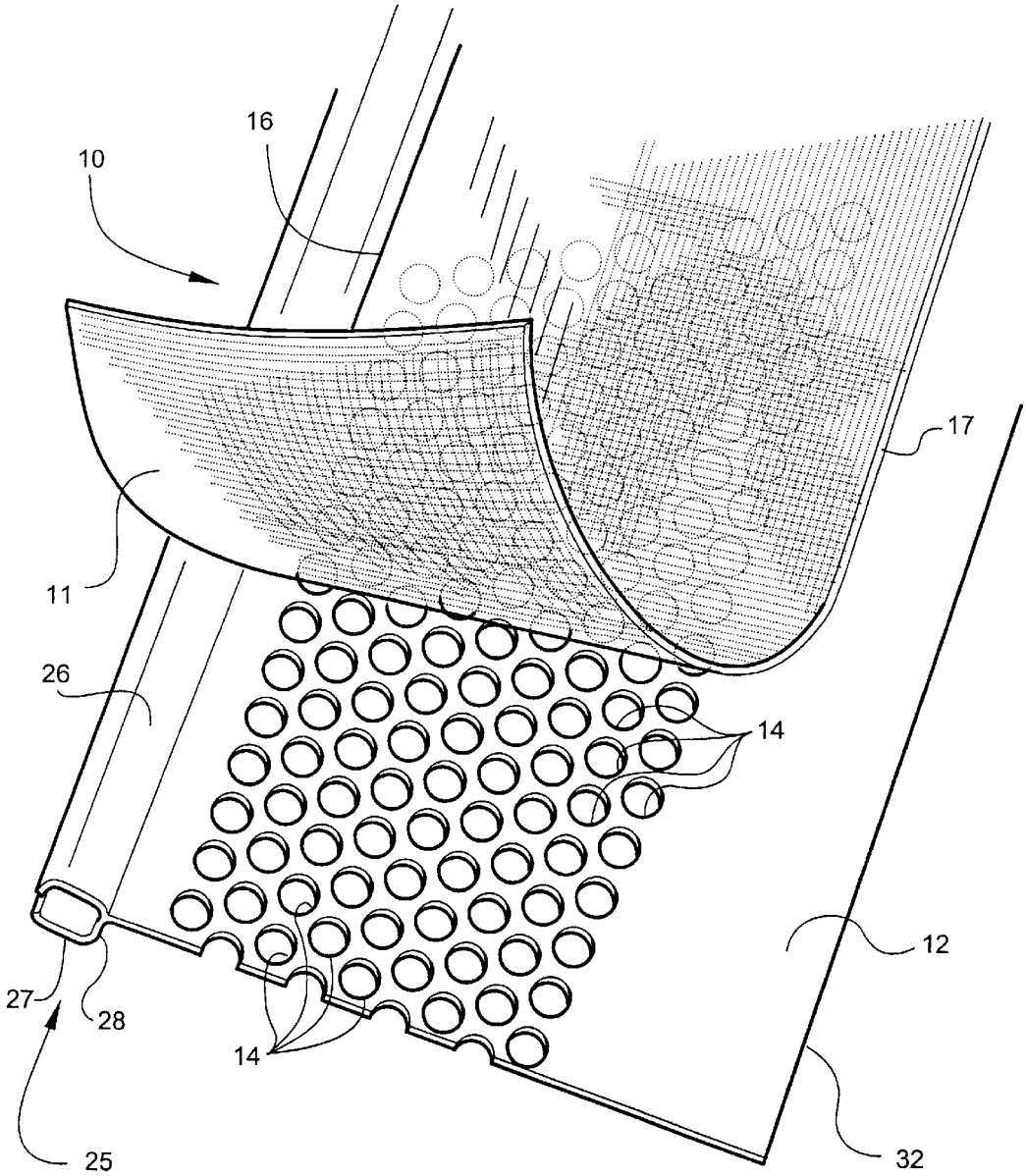
FIG. 1 is a fragmentary perspective view of a composite gutter guard according to one preferred embodiment of the invention, and showing a portion of the fine mesh layer pulled back from the guard panel.

Referring now specifically to the drawings, a composite gutter guard according to the present invention is illustrated in FIG. 1 and shown generally at reference numeral 10. The gutter guard 10 is especially adapted for use on standard, generally U-shaped gutters attached to residential homes and other buildings. The gutter guard 10 is formed of a composite filter assembly including a flexible fine-mesh fabric layer 11 applied to a semi-rigid, polymer guard panel 12. The mesh layer 11 overlies an area of filter openings 14 formed in the guard panel 12, and is attached to the guard panel 12 by continuous ultrasonic or heat welding along opposing longitudinal edges of the mesh layer 11. The mesh layer 11 is preferably formed of PVC-coated, woven fiberglass fabric which readily fuses to the polymer guard panel 12 during welding to form continuous and secure weld lines 16 and 17 along the entire length of the mesh layer 11. According to one embodiment, the filter openings 14 are approximately 1 centimeter in diameter, and the fine mesh layer 11 includes between 30 and 40 openings per square centimeter.

Figure 2:
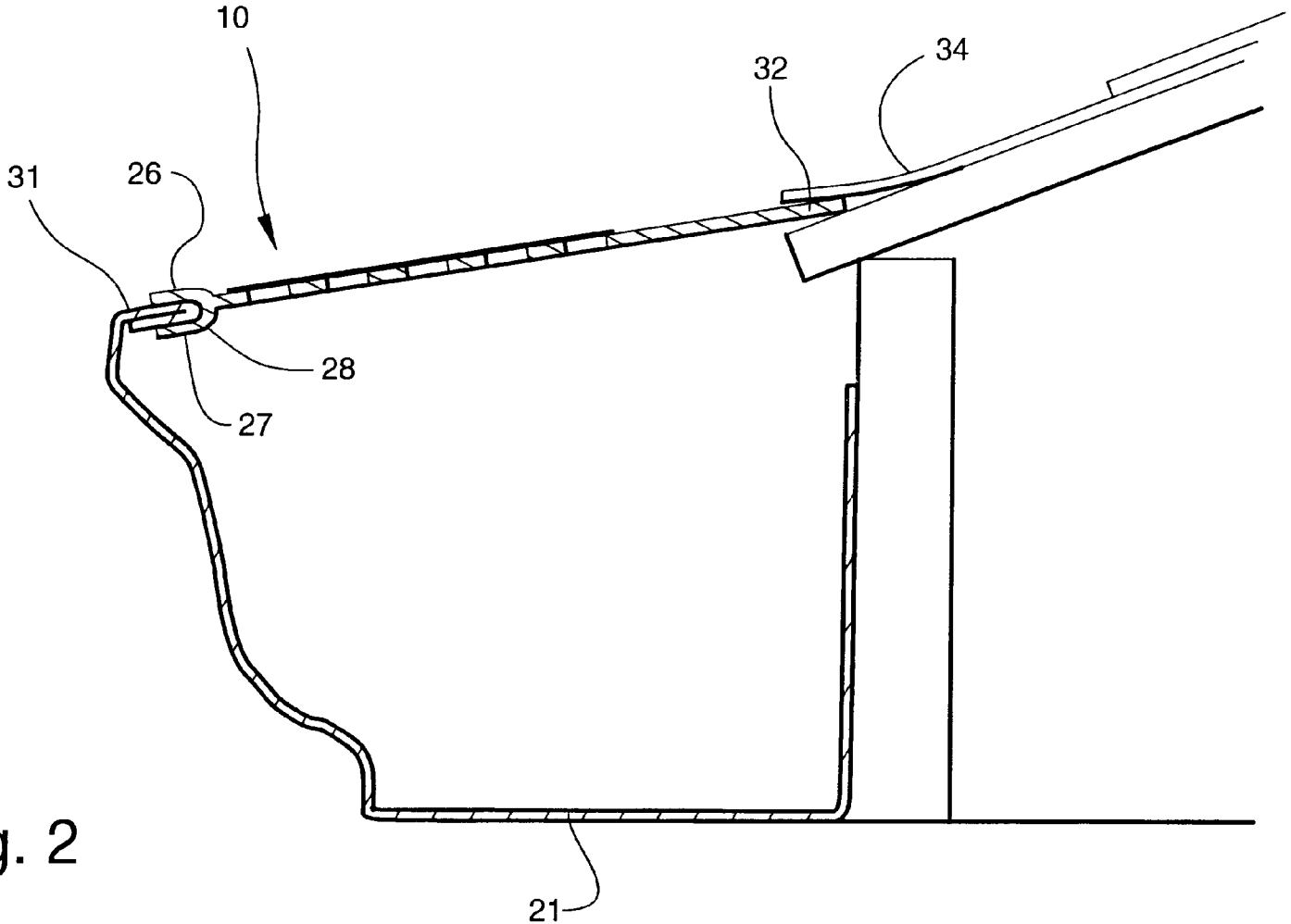
FIG. 2 is a cross-sectional view of the composite gutter guard positioned over the top opening of a conventional gutter.

Referring to FIGS. 1 and 2, the composite gutter guard 10 is positioned over the opening of the longitudinally-extending gutter 21, and functions to separate small twigs, leaves, pine needles, acorns, and other debris from rainwater entering the gutter 21 and passing through downspouts outwardly away from the foundation of the house or building. A longitudinal, generally C-shaped connector strip 25 of increased rigidity is integrally formed with the guard panel 12 along one longitudinal side edge of the gutter guard 10, and includes resilient spaced-apart top and bottom walls 26 and 27 formed with end wall 28 and adapted for receiving an inwardly-extending flange 31 of the gutter 21 to hold the gutter guard 10 in position during use. The opposite longitudinal side edge 32 of the gutter guard 10 fits beneath the lowermost row of shingles 34 attached to the roof of the house or building, such that rainwater and debris runs from the roof directly to the gutter guard 10 before entering the gutter 21. The gutter guard 10 is preferably formed in 3 foot lengths and in a substantially flat condition to avoid pinching the connector strip 25 and destroying its operability.

A composite gutter guard is described above. Various details of the invention may be changed without departing from its scope. Furthermore, the foregoing description of the preferred embodiment of the invention and the best mode for practicing the invention are provided for the purpose of illustration only and not for the purpose of limitation-the invention being defined by the claims.

What is claimed is:

1. A composite gutter guard adapted for being positioned at an opening of a longitudinally extending, generally U-shaped gutter used for collecting and distributing rainwater runoff from the roofs of residential homes and other buildings, said gutter guard comprising:

(a) an elongate polymer guard panel defining a plurality of spaced filter openings, said guard panel being adapted to extend laterally across the opening of the gutter and longitudinally along the length of the gutter;

(b) a polymer-coated mesh layer overlying said guard panel in an area of said filter openings and cooperating with said guard panel to capture and separate debris from rainwater runoff entering the gutter, said mesh layer having first and second opposing side edges and first and second opposing end edges; and (c) a continuous heat weld defining an uninterrupted longitudinal weld line connecting said mesh layer to said guard panel, and extending from one end edge of said mesh later to the opposing end edge of said mesh layer.

2. A composite gutter guard according to claim 1, and comprising a connecting member for securing said guard panel in position at the opening of the gutter.

3. A composite gutter guard according to claim 2, wherein said connecting member comprises a generally C-shaped connecting strip having resilient spaced-apart top and bottom walls adapted for receiving an inwardly-extending flange of the gutter to hold the gutter guard in position during use.

4. A composite gutter guard according to claim 1, wherein said mesh layer comprises fiberglass fabric.

5. A composite gutter guard according to claim 1, wherein said mesh layer comprises a PVC coating.

6. A composite gutter guard according to claim 1, wherein the filter openings in said guard panel are between 0.5 and 1.5 centimeters in diameter.

7. A composite gutter guard according to claim 1, wherein said mesh layer includes between 30 and 40 openings per square centimeter.

8. A composite gutter guard according to claim 7, wherein said heat weld comprises first and second laterally spaced weld lines adjacent respective first and second side edges of said mesh layer and extending continuously along the entire length of said mesh layer from one end edge thereof to the other.

9. A composite gutter guard adapted for being positioned at an opening of a longitudinally extending, generally U-shaped gutter used for collecting and distributing rainwater runoff from the roofs of residential homes and other buildings, said gutter guard comprising: (a) an elongate polymer guard panel defining a plurality of spaced filter openings, said guard panel being adapted to extend laterally across the opening of the gutter and longitudinally along the length of the gutter; (b) a polymer-coated fiberglass mesh layer said guard panel in an area of said filter openings and cooperating with said guard panel to capture and separate debris from rainwater runoff entering the gutter, said mesh layer having first and second opposing side edges and first and second opposing end edges; (c) a longitudinal weld line connecting said mesh layer to said guard panel, and extending continuously from one end edge of said mesh layer to the other; and (d) a connecting member for securing said guard panel in position at the opening of the gutter.

10. A composite gutter guard according to claim 9, wherein said connecting member comprises a generally C-shaped connecting strip having resilient spaced-apart top and bottom walls adapted for receiving an inwardly-extending flange of the gutter to hold the gutter guard in position during use.

11. A composite gutter guard according to claim 9, wherein said mesh layer comprises a PVC coating.

12. A composite gutter guard according to claim 9, wherein the filter openings in said guard panel are between 0.5 and 1.5 centimeters in diameter.

13. A composite gutter guard according to claim 9, wherein said mesh layer includes between 30 and 40 openings per square centimeter.

14. A method of forming a composite gutter guard adapted for being positioned at an opening of a longitudinally extending, generally U-shaped gutter used for collecting and distributing rainwater runoff from the roofs of residential homes and other buildings, said method comprising the steps of:

(a) forming a plurality of filter openings in an elongate polymer guard panel, the guard panel being adapted to extend laterally across the opening of the gutter and longitudinally along the length of the gutter;

(b) applying a polymer-coated mesh layer over the guard panel in an area of the filter openings, the mesh layer having first and second opposing side edges and first and second opposing end edges, and the mesh layer cooperating with the guard panel to capture and separate debris from rainwater runoff entering the gutter; and (c) welding the mesh layer to the guard panel along a continuous and uninterrupted longitudinal weld line extending from one end edge of the mesh layer to the opposing end edge of the mesh layer.

* * * * *

UNITED STATES PATENT AND TRADEMARK OFFICE

CERTIFICATE OF CORRECTION

PATENT NO. : 6,463,700 B2
DATED : October 15, 2002
INVENTOR(S) : Harry H. Davis

It is certified that error appears in the above-identified patent and that said Letters Patent is hereby corrected as shown below:

Column 4,
Line 30, delete “later” and insert -- layer --.

Signed and Sealed this

Third Day of February, 2004

JON W. DUDAS
*Acting Director of the United States Patent and Trademark Office*